United States Patent [19]

Everroad

[11] Patent Number: 5,048,138

[45] Date of Patent: Sep. 17, 1991

[54] SHOE SPIKE WRENCH AND CLEANING TOOL

[75] Inventor: Herbert L. Everroad, Scottsdale, Ariz.

[73] Assignee: Foot-Joy, Inc., Brockton, Mass.

[21] Appl. No.: 600,561

[22] Filed: Oct. 16, 1990

Related U.S. Application Data

[63] Continuation of Ser. No. 379,409, Jul. 13, 1989, abandoned.

[51] Int. Cl.[5] ..... B25F 1/00

[52] U.S. Cl. ..... 7/138; 81/177.8; 81/176.15; 81/437; 81/450

[58] Field of Search ..... 7/138; 15/105; 81/176.15, 177.6, 177.8, 437, 450

[56] References Cited

U.S. PATENT DOCUMENTS

| | | | |
|---|---|---|---|
| 1,186,807 | 6/1916 | Litomy | 7/138 X |
| 2,770,991 | 11/1956 | Myers | 7/138 X |
| 3,068,728 | 12/1962 | Sheperd | 81/177.7 |
| 3,105,257 | 10/1963 | Blagden | 81/176.15 X |
| 4,466,315 | 8/1984 | Boschetto et al. | 81/437 |

FOREIGN PATENT DOCUMENTS

| | | | |
|---|---|---|---|
| 13668 | 5/1881 | Fed. Rep. of Germany | 81/177.7 |

*Primary Examiner*—James G. Smith
*Attorney, Agent, or Firm*—Pennie & Edmonds

[57] ABSTRACT

A shoe tool having a generally cylindrical gripping surface on a handle, such surface sized and shaped for firm hand gripping, an L-shaped passageway in the head with a pin therethrough to connect at all times a shaft to the handle while permitting the shaft to be held in a working position or a folded rest position. The shaft carries a working head which is a wrench, a cleaning tool, or both.

2 Claims, 1 Drawing Sheet

SHOE SPIKE WRENCH AND CLEANING TOOL

This is a continuation of application Ser. No. 07/379,409 filed July 13, 1989, now abandoned.

BACKGROUND OF THE INVENTION

Hand-operated shoe spike wrenches having fixed and integral handles have been proposed (U.S. Pat. No(s). 2,448,805, 2,459,610, 2,539,532, 2,770,991, and 3,447,171) while other wrenches proposed have included folding or removable handles (U.S. Pat. No(s). 3,243,831 and 4,535,987).

Various shaped handles have also been suggested to facilitate hand operation (U.S. Pat. No. 4,262,562).

SUMMARY OF THE INVENTION

Briefly, the invention comprises a combination handle and shaft as part of a shoe spike wrench and/or cleaning tool including a handle, a folding shaft section, a head on the shaft section which head carries the spike-engaging wrench projections and serves as a container and mount for a cleaning nail. The handle and shaft are connected in an articulating manner to permit folding for compact storage. A removable cap over the stem end retains the spike and houses the wrench projections or performs both functions.

It is a feature that the cleaning nail may be stored with the shaft section or positioned to protrude for cleaning. The cap serves to hold the cleaning nail in operative position.

DESCRIPTION OF THE PREFERRED EMBODIMENT

Figure 1:
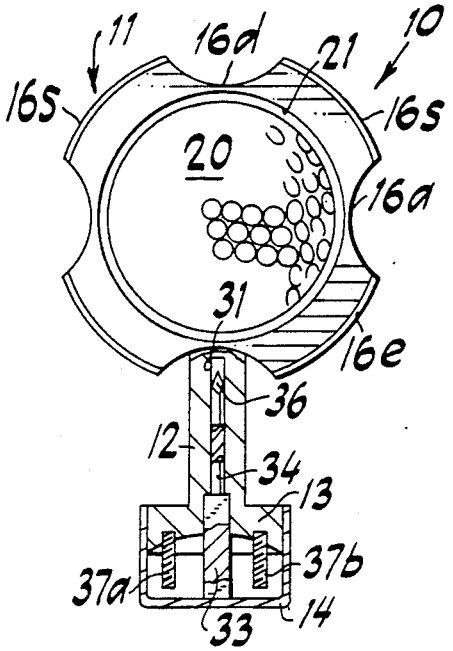
FIG. 1 is a front elevational view of the tool in folded storage position with the shaft, nail and the cap in partial section.

In the figures, tool 10 comprises handle 11, shaft 12, head 13, and cap 14. Handle 11 in turn comprises cylindrical body 16 having four (4) grip indentations 16*a–d* and golf ball crown 20. Crown 20 is mounted using an adhesive in body recess 17 which recess 17 has a bevel rim surface 21. Body 16 also carries peripheral bevels 16*e*, 16*f*. Body 16 includes body extension 18. The cylindrical surface areas 16*s* of body 16 between grip indentations 16*a–d* together with such indentations provide a peripheral surface area generated about an axis X, coincident with or parallel to the axis of shaft 12, such surface areas having an effective shape and size for gripping by hand to accomplish the torque required to set and remove shoe spikes.

Figure 2:
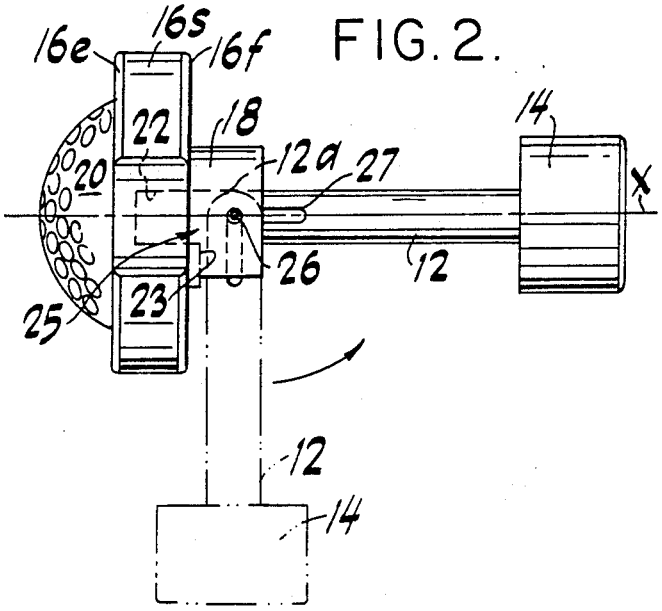
FIG. 2 is a side elevational view showing the shaft in working and storage positions.
Figure 3:
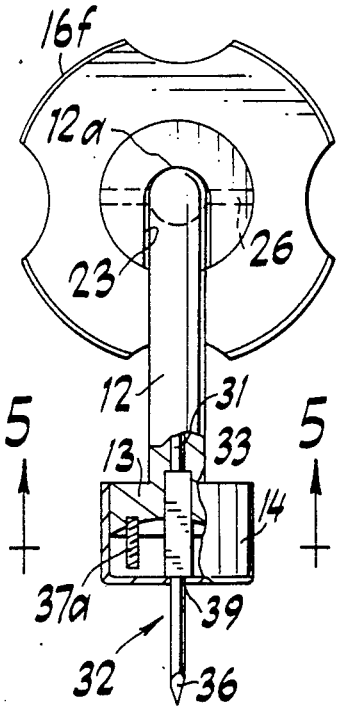
FIG. 3 is a back elevational view showing the tool in folded position and the shaft-head in partial section.

Within body 16 and body extension 18 is shaft-receiving passageway 22. Perpendicular to one end of passageway 18 there is formed as part of the passageway a shaft rest cutaway slot 23 (FIGS. 2 and 3) to accommodate shaft 12 in its folded rest position (FIGS. 2 and 3). The straight passageway 22 and cutaway slot 23 together form an L-shaped passageway 25. To maintain handle 11 and shaft 12 connected at all times, a pin 26 is mounted in body extension 18 which stationary metal pin 26 passes through and rides in side-by-side slot 27 in shaft 12. Shaft 12 has rounded upper end surface 12*a*. Passageway 22, surface 12*a* and slot 27, are shaped, located and proportioned so that surface 12*a* is frictionally and forcefully engaged against the wall of passageway 22 when shaft 12 is in its folded rest position (dashed and dotted lines of FIG. 2). This lock force holds shaft 12 in its rest position until a measurable force is applied to shaft 12 to move it.

Figure 4:
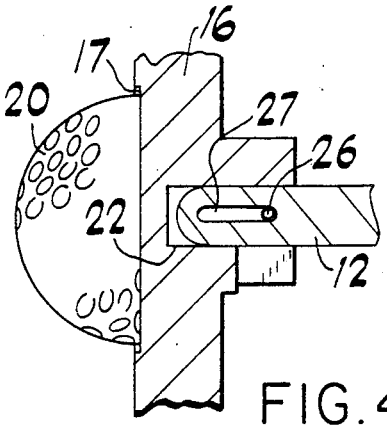
FIG. 4 is a partial sectional view showing the shaft positioned tightly in the handle shaft-receiving passageway.
Figure 5:
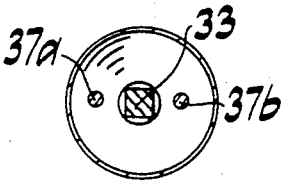
FIG. 5 is a sectional view taken along line 5—5 of FIG. 3.
Figure 6:
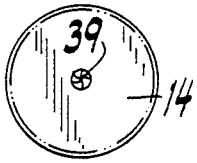
FIG. 6 is an end view of the removal cap, a view looking upwardly in FIGS. 1 and 3.

When shaft 12 is moved to its operative position, it is pivoted around pin 23 to overcome the lock force to place it in position for entry into passageway 22. Shaft 12 is then pushed further into passageway 22 until pin 23 abuts the end of slot 27 (FIG. 4). Passageway 22 provides a close it with shaft 12 so that shaft 12 is controlled by handle 11 without wobble during operation as a wrench or cleaning tool.

Shaft 12 carries internal recess 31 having a rectangular cross-section to receive the rectangular base portion of cleaning nail 32. Nail 32, preferably all-metal, includes stem 34 with cleaning point 36. Head 13 has mounted in it a pair of shoe spike engageable metal projection prongs 37*a*, 37*b*. Preferably, the tool components are molded of suitable plastics except pin 26, prongs 37*a*, 37*b* and nail 32. Shaft 12 is of suitable length to that if the operator's hand slips it will not contact the shoe spike, wrench, prong, or cleaning nail, all of which can cut, scar or break skin of the hand.

Prongs 37*a*, 37*b* protrude a sufficient distance from molded head 13 to permit their engagement with recesses in standard shoe spikes. Prongs 37*a*, 37*b* are threaded to assist in direct anchorage in the plastic head or can be screwed in compatible threaded sockets in head 13 (not shown). Where sockets are used the length of prong exposure from the head can be varied. Tool 10 is used to screw spikes, which are threaded in and out of shoe sockets (not shown), through hand turning of handle 11 which in turn rotates shaft 12 and head 13. The indentations 16*a–d* assist in gripping the tool handle 11 as explained above, and crown 20 assists in the hand exerting a downward force to assure prong or nail engagement throughout the wrench and cleaning operations.

Turning to use of the tool head and shaft with the cleaning nail 32, the nail is stored in shaft recess 31 with a portion protruding below head 13 but within cap 14. Cap 14 positioned, in frictional fit, on head 13 covers prongs 37*a*, 37*b* and also covers and retains nail 32 (FIG. 1). When nail 32 is appropriate for cleaning the holes in the shoe spikes or other shoe parts, cap 14 is removed, nail 32 removed from recess 31, turned end for end and returned to recess 31 with nail base 33 mounted in recess 31 (FIG. 3). Base 33 is rectangular in cross-section but may be of another shape since rotation of nail 32 is undesirable but not critical. Cap 14 is then placed on head 13 with nail stem 34 passing through cap hole 39 (FIG. 3). Since nail base 33 is larger in cross-section than cap hole 39, cap 14 holds nail 32 in cleaning position.

While a combination of wrench and cleaner are shown and described, the tool may be constructed or used solely as a wrench or solely as a cleaning tool.

I claim:

1. A combination shoe wrench and cleaning tool comprising a. a handle having a hand grippable surface generated around an axis;

b. an elongated shaft hingedly engaged to the head for positioning along such axis for operation and perpendicular to the axis for compact storage;

c. a head on the shaft carrying wrench prongs;

d. a hollow in the shaft to hold and store a cleaning element; and e. a cap frictionally engageable with the head, such cap having a hole to permit the cleaning element to protrude.

2. The tool of claim 1 in which the head is molded of plastic.

* * * * *